United States Patent [19]

Olson

[11] 4,076,208

[45] Feb. 28, 1978

[54] BLOWOUT PREVENTER RAM LOCK

[75] Inventor: Richard A. Olson, Houston, Tex.

[73] Assignee: Hydril Company

[21] Appl. No.: 729,269

[22] Filed: Oct. 4, 1976

[51] Int. Cl.[2] ..... E21B 33/06

[52] U.S. Cl. ..... 251/1 A; 92/17; 92/24; 92/27

[58] Field of Search ..... 92/17, 24, 27, 28; 251/1 R, 1 A, 94; 188/67

[56] References Cited

U.S. PATENT DOCUMENTS

| | | | |
|---|---|---|---|
| 2,643,642 | 6/1953 | Geyer | 92/17 |
| 3,104,593 | 9/1963 | Clifton et al. | 92/27 X |
| 3,208,357 | 9/1965 | Allen et al. | 251/1 A X |
| 3,242,826 | 3/1966 | Smith | 92/24 |
| 3,267,818 | 8/1966 | Chambers | 92/17 |
| 3,353,455 | 11/1967 | Berry | 92/27 X |
| 3,738,229 | 6/1973 | Kraft | 92/17 |
| 3,941,141 | 3/1976 | Robert | 251/1 A X |
| 3,983,792 | 10/1976 | Furtner | 92/24 X |
| 3,994,205 | 11/1976 | Ekdahl et al. | 92/17 X |

*Primary Examiner*—Martin P. Schwadron
*Assistant Examiner*—Richard Gerard
*Attorney, Agent, or Firm*—Pravel, Wilson & Gambrell

[57] ABSTRACT

A new and improved ram lock for blowout preventer rams which permits locking of the ram at multiple and adjustable positions to compensate for wear on sealing elements of blowout preventer rams and increase sealing action of the ram without requiring separate special control lines. Automatic locking of the ram at a desired position, such as in adjustable sealing positions to compensate for ram elastomer wear, is obtained.

40 Claims, 5 Drawing Figures

BLOWOUT PREVENTER RAM LOCK

CROSS-REFERENCE TO RELATED APPLICATIONS:

The present invention relates to blowout preventer ram locks, as does co-pending U.S. patent application Ser. No. 605,857, filed Aug. 19, 1975, and assigned to the assignee of the present invention.

BACKGROUND OF THE INVENTION

The present invention relates to locks for blowout preventer rams.

In ram blowout preventers, each closure of the ram causes a certain amount of wear of the ram sealing elements which move into the borehole of the preventer for sealing contact with a pipe or other object, such as another ram. During succeeding closures of the rams, the effectiveness of the seal was reduced when the ram was locked in sealing position due to such wear.

Certain prior art blowout preventer ram locks, such as in U.S. Pat. Nos. 3,242,826 and Re27,294, used snap rings or collets mounted with a ram piston for locking. When the piston reached a predetermined locking position defined by a groove in the ram piston cylinder, the snap ring moved into the groove to lock the ram and piston in place. However, with this structure, only one locking position of the ram, as defined by the relative position of the snap ring and groove, was obtained. Change of the locking position to compensate for sealing element wear required adjustment of the relative positions of the locking elements, requiring undesirable disassembly of the blowout preventer cylinders for such adjustments to be made.

Other blowout preventer ram locks, such as in U.S. Pat. No. 3,208,357, used a taper locking pin which moved into locking position behind the ram piston once the ram had been moved into sealing position. However, extra hydraulic operating and control lines, separate and distinct from those for causing ram piston movement, were required, increasing the complexity of the control system for those types of ram locks.

In the co-pending application referred to above, these shortcomings have been for the most part overcome. However, locking action in such co-pending application was based on frictional engagement of locking rings in locking position. For high loads, however, this frictional engagement could be subject to slippage. In certain instances, unlocking of the frictionally engaging locking structure could cause difficulties. Also, dirt or particles in the operating fluid could cause galling of the frictionally engaging locking surfaces.

SUMMARY OF THE INVENTION

Briefly, the present application provides a new and improved ram lock for blowout preventer rams which automatically locks the ram against outward movement during inward movement of the ram to a closed position in a bore of the blowout preventer, and further locks the ram at an adjustable closed position to achieve the desired degree of sealing contact with a well pipe or like object in the bore.

A ram carrier moves the ram through the blowout preventer to and from the desired closed position. The ram carrier moves in the preventer in response to opening and closing fluid pressures and has a threaded surface which continuously engages a similar threaded surface on a lock nut rotatably moving with respect to the ram carrier. The lock nut also includes a movable clutch plate, having ratchet teeth, which is mounted with and moves with the lock nut. A fixed clutch plate having ratchet teeth adapted to engage the ratchet teeth of the movable clutch plate is mounted with the blowout preventer. The ratchet teeth of the clutch plates, when engaged, permit unidirectional rotational movement of the lock nut during inward advance of the ram carrier to the closed position. The engaged ratchet teeth lock the ram carrier, however, against reverse movement, thereby automatically locking the ram. Further, the engaged ratchet teeth permit the ram carrier to be moved inwardly to an adjustable closed position, for example to compensate for ram elastomer wear, while the lock automatically locks the ram and ram carrier in this adjustable closed position.

An unlocking piston responds to opening fluid pressure by disengaging the ratchet teeth of the movable clutch plate from the ratchet teeth of the fixed clutch plate, unlocking the ram and ram carrier and permitting the ram to move from the closed position in response to the opening fluid pressure.

DESCRIPTION OF THE PREFERRED EMBODIMENT

Figure 1:
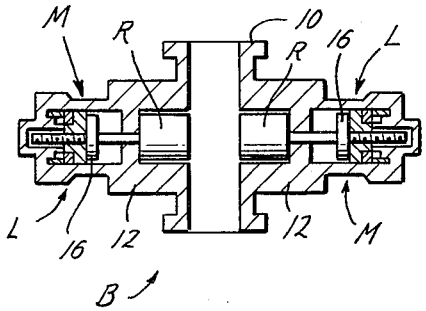
FIG. 1 is a vertical sectional view of a ram blowout preventer according to the present invention.

In the drawings, the letter B (FIG. 1) refers generally to a blowout preventer of this invention which is formed with a pair of rams R which are locked into place by a locking apparatus L of the present invention automatically and at adjustable closed positions for sealing contact with a well pipe or like object. The blowout preventer B is typically mounted in a stack of blowout preventers or in a string of well casing or pipe.

As is conventional, the rams R are disposed in a conventional blowout preventer body or housing 10 having a longitudinal well bore **10*a* formed therethrough, through which well pipe or other objects such as well tools may pass in normal operations conducted with the blowout preventer B in an open or retracted position (FIG. 1). In the open position, the rams R are mounted in conventional recesses in the body 10 adjacent the bore 10*a*. The rams R move in response to a motive or power means M from their respective recesses into an extended or closed position in the bore 10*a*** for sealing contact of conventional sealing elements with a well pipe, well tool or another ram. The sealing elements of the ram are conventional and are carried by a conventional ram block of the ram R. Since the sealing elements and ram blocks are conventional, they are not shown in the drawings in order to more clearly show other structures.

The rams R may be any of several types of blowout preventer rams. For example, the rams R may be of the type known as a "blind" ram for sealing against another "blind" ram of similar structure; the type wherein the sealing inner portions of the rams are shaped for sealing about a pipe or well tool in the bore, as well as with one another on each side of the pipe or well tool; or the shear-seal ram type for shearing tubing or objects in the bore 10*a* in conjunction with a similar shear seal ram and thereafter sealing the bore 10*a* of the preventer B against well pressure.

Figure 2:
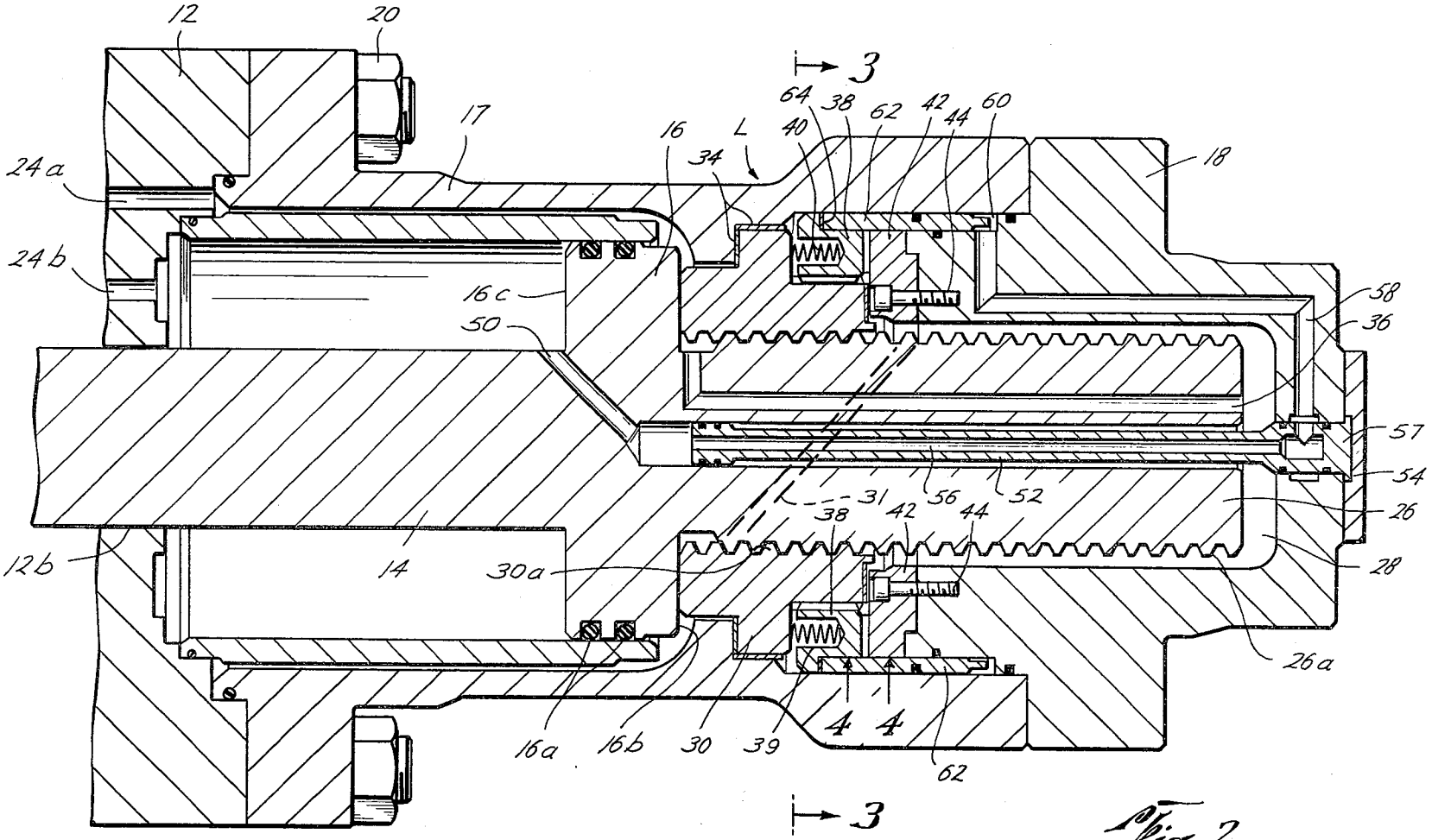
FIG. 2 is a vertical sectional view of a ram blowout preventer and lock of the present invention in an open position.

A conventional head or bonnet 12 (FIG. 2) is connected to each side of the body or housing 10 and each of such heads or bonnets has a conventional recess aligned with the recesses in the housing or body 10 so that the rams R may be received in such recesses when they are in the retracted or open position (FIG. 1). A piston rod 14 (FIG. 2) extends through suitable sealing structure in an opening 12*b* of each head or bonnet 12. Each piston rod 14 extends to a piston or ram carrier 16 of conventional construction which is disposed in a ram piston cylinder 17 with O-rings 16*a* or other suitable seals therebetween. The piston 16 moves in response to the motive means M within the cylinder 17 in a manner to be set forth.

The ram piston 17 is mounted with the bonnet 12 by bolts 20 or other suitable fastening means. Similarly, a cylinder head cap or end closure 18 is mounted with the ram piston cylinder 17 by conventional bolts or other suitable fastening means.

Figure 2A:
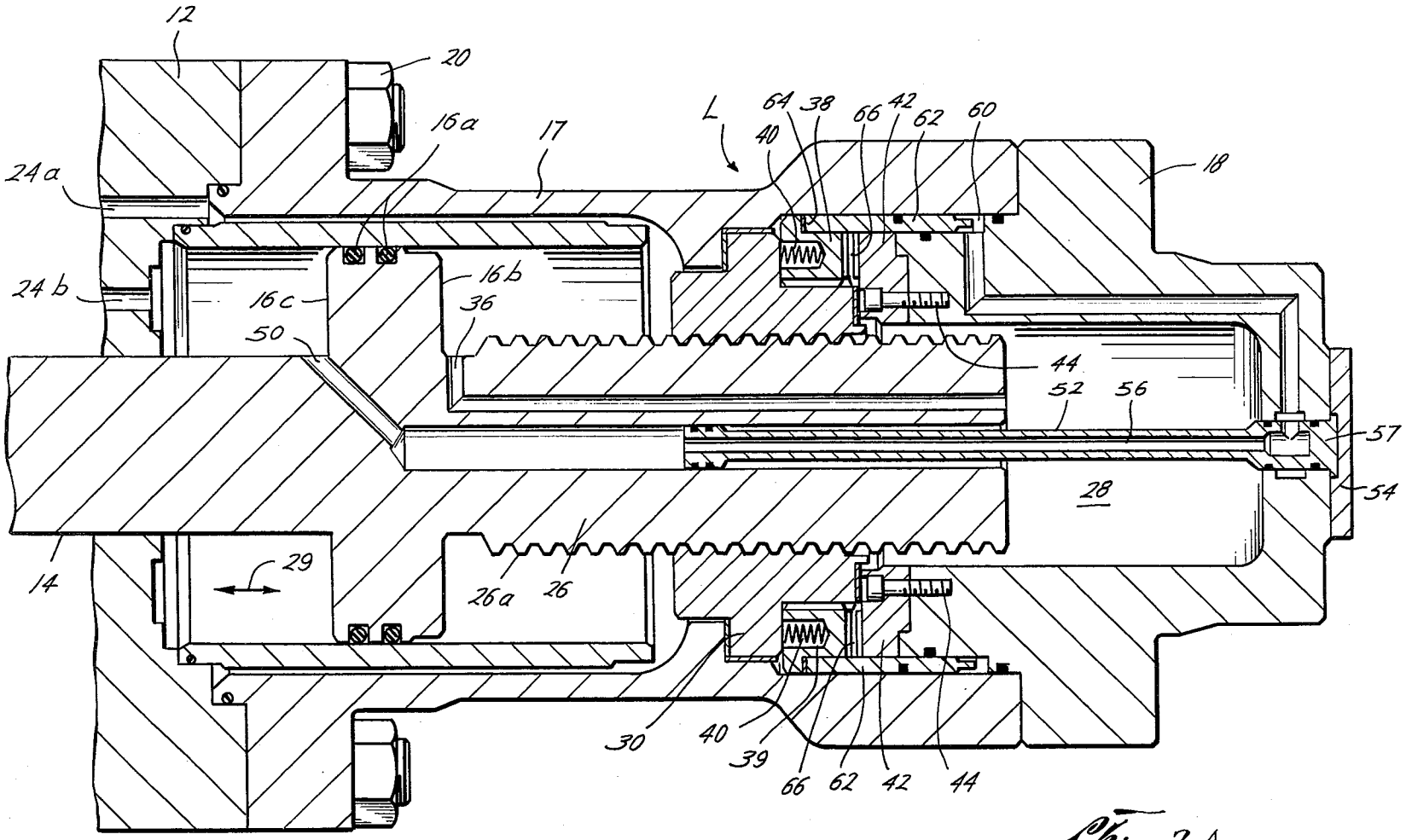
FIG. 2A is a vertical sectional view of the blowout preventer of FIG. 2 in a partially open position.

For purposes of illustration in the preferred embodiment, the motive means M includes a fluid inlet line 24*a* (FIG. 2) shown for introducing air, hydraulic fluid or other operating fluid pressure into the cylinder 17 against an outer surface 16*b* of the piston 16 for moving the piston 16 inwardly (to the left as viewed in FIGS. 2 and 2A) to move the rams R toward the center of the bore 10*a*. An opening fluid conduit 24*b* is formed through the body of the bonnet 12 for introducing air, hydraulic fluid or other operating fluid pressure into the cylinder 17 against an inner surface 16*c* (FIG. 2) of the piston 16 for moving the piston 16 outwardly (to the right as viewed in FIGS. 2 and 2A) to retract the ram R from the closed position in the bore 10*a*.

It should be understood that various systems for providing operating or motive power to the blowout preventer B may be employed and the invention is not limited to the specific form illustrated in the drawings. It should also be understood that a similar power means is provided for the left-hand ram R as viewed at FIG. 1 in the same manner as the power means 91 illustrated for the right-hand ram R in FIG. 2.

Considering now the lock L, a piston tail rod 26 of the ram piston 16 extends rearwardly from the piston 16 and moves into and out of an opening 28 in the cylinder head 18, as the piston 16 (FIG. 2A) moves transversely inwardly and outwardly (as indicated by an arrow 29) with respect to the bonnet 12 in response to the power means M. The piston tail rod 26 has a threaded external surface 26*a* formed thereon which is continuously engaged with a threaded inner surface 30*a* of a lock nut 30 of the lock L.

The threaded surfaces 26*a* and 30*a* are in the form of multi-start helical threads, as indicated by phantom lines 31, to prevent binding therebetween in response to fluid pressure which might otherwise resist relative movement between the tail shaft 26 and lock nut 30. An eight-start thread may be used, if desired, although it should be understood that helical threads having other numbers of start may be used as well.

The threaded surfaces 26*a* of the tail shaft 26 and 30*a* of the lock nut 30 engage so that the lock nut rotates in a clockwise direction (as indicated by an arrow 32 in FIG. 3) in response to inward movement of the piston 16. As will be set forth below, the lock L restrains rearward movement of the piston 16 until unlocked, at which time the threaded surfaces 26*a* and 30*a* cause the lock nut 30 to move in a reverse or counter-clockwise direction in response to outward movement of the piston 16. Suitable bearings are provided between the lock nut 30 and cylinder 17 to reduce friction during relative movement therebetween.

It is to be noted that the piston 16 and tail shaft 26 do not rotate with respect to the cylinder 17 or bonnet 12 during inward or outward movement. When the lock L is disengaged, the lock nut 30 rotates with respect to the tail shaft 26 in the manner set forth above. When engaged, the lock L restrains rearward movement of the piston 16.

A fluid conduit 36 is formed in the piston tail rod 26 to provide fluid communication between the space in the cylinder 17 rearward of the surface 16*b* on the piston 16 and the opening 28 in the cylinder head 18 so that operating fluid introduced through the fluid inlet 24*a* may pass into the opening 28 to assist in inward movement of the ram piston 16.

The lock L further includes a movable clutch plate 38 mounted with the lock nut 30 by means of splined surfaces therebetween (FIG. 3) or other suitable connecting means so that the movable clutch plate 38 moves along with the lock nut 30 with respect to the tail shaft 26 during inward and outward movement of the ram R.

Figure 3:
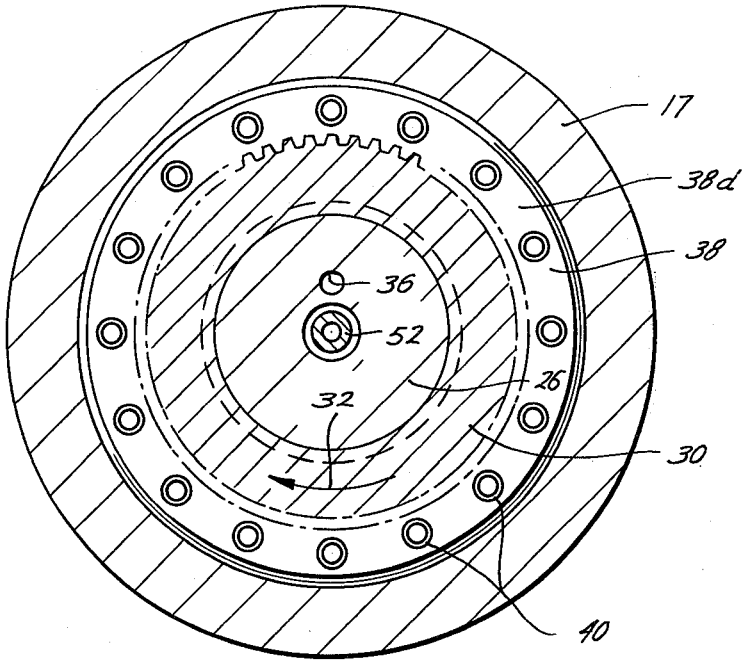
FIG. 3 is a cross-sectional view along the lines 3—3 of FIG. 2.

The movable clutch plate 38 has a plurality of mounting sockets 39 formed therein on an opposite surface 38*d* (FIG. 3) from the ratchet teeth 38*a* for receipt of the load springs 40 or other suitable resilient means in the sockets 39 (FIG. 3). The loading springs 40 extend outwardly from the sockets 39 in the clutch plate 38 into engagement with the lock nut 30 (FIG. 2) and urge the movable clutch plate 38 rearwardly away from the lock nut 30, into engagement with a fixed clutch plate 42 of the lock L.

Figure 4:
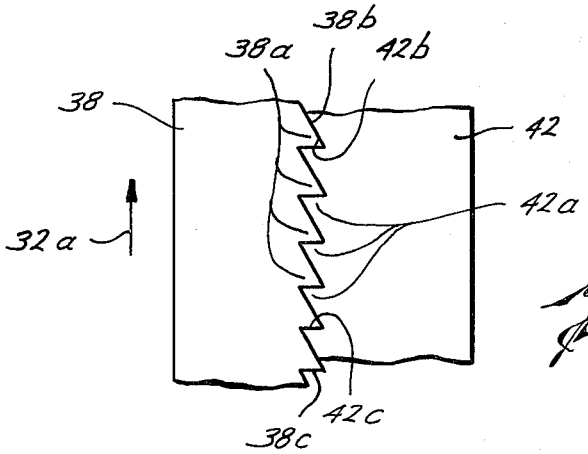
FIG. 4 is a cross-sectional view along the lines 4—4 of FIG. 2.

The movable clutch plate 38 has ratchet teeth 38*a* (FIG. 4) formed on a rear surface thereof which are selectively engageable, in a manner to be set forth, with opposing ratchet teeth 42*a* of the fixed clutch plate 42. The clutch plate 42 is fixedly mounted by face bolts 44 or other suitable means with the cylinder head 18. The clutch plate might, if desired, be integrally formed with the cylinder head 18.

Each of the ratchet teeth 38*a* on the movable clutch plate 38 has a sloping ramp surface 38*b* (FIG. 4) formed thereon which contacts a conforming sloping ramp surface 42*b* of corresponding teeth 42*a* on the fixed clutch plate 42. Each of the ratchet teeth 38*a* and 42*a* further has a planar stop surface 38*c* and 42*c*, respectively, formed between their adjacent ramp surfaces 38*b* and 42*b*.

The clutch plate 38 is mounted with the lock nut 30, as has been set forth, and the engaged sloping ramp surfaces 38*b* and 42*b* of the ratchet teeth permit the movable clutch plate 38 to move clockwise therewith, as indicated by an arrow 32*a* (FIG. 4) when the piston 16 is moving inwardly.

During the inward movement of the piston 16, closing fluid pressure is admitted from inlet 24*a* into cylinder 17 against surface 16*b* of the piston 16. The clutch plate 38 and lock nut 30 are automatically moved rearwardly by the closing fluid pressure in cylinder 17, bringing the movable clutch plate 38 into engagement with fixed clutch plate 42. In this manner, the ram R is locked against rearward movement, which might be caused by forces such as well bore pressures and the like, causing the lock L to be activated and locked.

The lock L is activated by engagement of the ratchet teeth 38*a* and 42*a* of the engaged clutch plates 38 and 42 along planar surfaces 38*c* and 42*c*. The ratchet teeth 38*a* and 42*a* are maintained in engagement by the closing fluid pressure in the cylinder 17, as well as by the force of the load springs 40. In the locking position of lock L, the movable clutch plate 38 moves, as indicated by arrow 32*a* (FIG. 4) with the lock nut 30 during inward movement of the piston 16. The resilient load springs 40, however, yield sufficiently to permit relative ratcheting movement between the ratchet teeth 38*a* of moving clutch plate 38 and the ratchet teeth 42*a* of the fixed clutch plate 42 as the piston 16 moves inwardly.

A fluid conduit 50 is formed in the piston 16 to communicate closing fluid pressure from the inlet 24*b* rearwardly through the tail shaft 26. A tube or stinger 52 is mounted in the conduit 50 within the tail shaft 26 and suitable seals are provided therebetween. The stinger 52 is mounted at an outer end thereof with the cylinder head 18, with suitable seals therebetween, by a mounting plate 54 or other suitable means.

A conduit 56, formed extending through the stinger 52, is in fluid communication at an L-joint 57 of stinger 52 with an unlocking fluid conduit 58 formed in the cylinder head 18. The unlocking conduit 58 conveys unlocking fluid pressure from the conduit 56 to an annular unlocking chamber 60 formed between cylinder head 18 and cylinder 17.

An annular unlocking piston 62 is mounted in the unlocking chamber 60 in contact with the movable clutch plate 38 outwardly of the ratchet teeth 38*a* thereon through a bearing 64. Suitable seals are provided between unlocking piston 62, cylinder 17 and cylinder head 18 to seal the unlocking chamber 60. The unlocking piston 62 moves from the locking position (FIG. 2) to the unlocking position (FIG. 2A) in response to abatement of locking or closing fluid pressure on inlet 24*a* and introduction of opening or unlocking fluid pressure in the cylinder 17 from inlet conduit 24*b* through the conduit 50, stinger 52 and conduit 58, which convey such pressure to the unlocking chamber 60.

As the piston 62 moves to the unlocking position, the force of springs 40 is overcome and movable clutch plate 38 is moved inwardly to a position (FIG. 2A) where a gap 66 is present and there is no engagement between the ratchet teeth 38*a* and 42*a*. With the ratchet teeth 38*a* and 42*a* out of engagement with each other, locking action between the lock nut 30 and body of the blowout preventer is removed, and the threaded surface 26*a* of the tail shaft 26 is permitted to pass rearwardly through the surface of the lock nut 30, with the lock nut 30 and clutch plate 38 rotating in the reverse direction to the arrow 32 (FIG. 3).

It should be understood that a lock L is provided for the left-hand ram R as viewed in FIG. 1 in the same manner as the lock L discussed above for the right-hand ram R in FIG. 2.

In the operation of the blowout preventer B with the lock L, when it is desired to move the ram R inwardly from the open position (FIG. 1) to the closed position (FIG. 2), operating fluid pressure is provided through the fluid inlet 24*a* to act on the ram piston 16 and move the ram R inwardly. The operating fluid introduced into the cylinder 17 from the inlet 24*a* concurrently acts to move the clutch plate 38 to a position where the ratchet teeth 38*a* engage the ratchet teeth 42*a* of fixed clutch plate 42. Engagement of the ratchet teeth 38*a* and 42*a* in the locking position occurs during initial stages of inward movement of the piston 16 from the open position, for reasons to be set forth. Locking fluid pressure further passes from the cylinder 17 into the socket 28 in the cylinder head 18 through the conduit 36 in the tail shaft 26 of the piston 16, to assist in causing inward movement of the piston 16.

With the ratchet teeth 38*a* of clutch plate 38 moved into the locking position (FIG. 2) with the ratchet teeth 42*a* of the clutch plate 42 from the outset of inward movement of the piston 16, contact is maintained between the ratchet ring teeth 38*a* and 42*a* by the springs 40. In this manner, during all stages of inward advance of the piston 16 with respect to the bore 10*a* of the preventer B, the lock nut 30 freely rides and rotates with respect to the piston tail shaft 26 permitting continuous inward advance of the ram R due to the relative movement of the sloped ratchet teeth 38*b* and 42*b* permitted by the springs 40.

However, at substantially all positions of the ram R with respect to the bore 10*a* during such inward movement, the flat surfaces 38*c* and 42*c* of the ratchet teeth 38*a* and 42*a* are engaged and locked against any rearward force on the piston 16, locking so that the ram R is locked and restrained against such rearward movement. In this manner, the lock L automatically locks the ram piston 16 and the ram R against rearward movement at any position during inward movement thereof. It is to be noted that this automatic locking of the lock L occurs in response to the same fluid pressure which moves the piston 16 inwardly, since the lock L is continuously engaged with the piston 16, and thus without the need for a separate and distinct locking fluid control system from that of the moving fluid system.

Further, once the ram R has reached an initial sealing position contacting a well pipe or other object in the bore 10*a* of the preventer B, it is possible to compensate for wear of the blowout preventer sealing elements, typically elastomer or other sealing material. Once the initial closed position has been reached with the ram block forcing the ram sealing elements into an initial seal with the object in the bore 10*a*, increased pressure is introduced through the fluid inlet 24*a* to act on the ram piston 16 and move the piston 16 and ram R further inwardly. The ram R is moved further inwardly in this manner with the ram block forcing the sealing elements thereof into closer engagement with the object in the bore 10*a* increasing the feed of the sealing elements into contact with the object to compensate for any wear or loss of the sealing elements until the desired degree of sealing contact between the object in the bore and the ram R is obtained. It is to be noted that with the threaded contact between the tail shaft 26 of the piston 16 and the lock nut 30 the adjustable locking position obtained with the lock L may be selectively varied over a wide range of positions to achieve the desired seal in contrast to a number of discrete and fixed positions. It is further to be noted that automatic mechanical locking of the lock L is maintained during movement of the ram R to the adjustable closed position.

Once the ram R is in the desired sealing position, the pressure of the operating fluid in the fluid inlet 24*a* may be abated and the ram R remains locked in the sealed position automatically by the lock L due to the locking engagement of the ratchet teeth 38*a* and 42*a*, forming a locking connection between the ram R and the remainder of the blowout preventer B.

When it becomes desirable or necessary to unlock the ram R from the adjustable closed position, suitable unlocking fluid pressure is provided through the fluid inlet 24*b*. The fluid pressure through the inlet 24*b* acts on the inner surface 16*b* of the piston 16 to move such piston and the ram R rearwardly with respect to the blowout preventer B. Further, the fluid pressure is concurrently supplied through conduits 50, 56 and 58, in the manner set forth, to the unlocking chamber 60, moving the piston 62 into engagement with the movable clutch plate 38 and causing the ratchet teeth 38*a* and 42*a* to move out of engagement, unlocking the lock L in order to permit rearward movement of the piston 16.

The foregoing disclosure and description of the invention are illustrative and explanatory thereof and various changes in the size, shape and materials as well as in the description of the preferred embodiment may be made without departing from the spirit of the invention.

I claim:

1. In a blowout preventer having at least one blowout preventer ram movable therein to adjustable closed positions for sealing contact with a well pipe or the like in a bore of the blowout preventer, a ram lock for locking the ram at the adjustable closed positions, comprising:

(a) ram carrier means comprising a ram piston having a piston rod with a threaded surface formed thereon for moving the ram to the adjustable closed positions in the blowout preventer;

(b) lock means for locking said ram carrier means at adjustable closed positions, comprising:

(1) a lock nut having a threaded surface formed thereon and engaged by said threaded surface on said ram piston rod for rotational movement with respect thereto during movement of the ram;

(2) a movable clutch plate mounted with said lock nut for rotational movement therewith, said movable clutch plate having ratchet teeth formed thereon;

(3) a fixed clutch plate having ratchet teeth formed thereon; and (4) means mounting said fixed clutch plate with the blowout preventer against relative movement with respect thereto; and (c) means for moving said ratchet teeth of said fixed clutch plate and said movable clutch plate into engagement to lock said ram carrier means against outward movement as the ram is moving inwardly.

2. The structure of claim 1, wherein closing fluid pressure is introduced against said ram carrier means to move the ram to the closed position, and wherein said means for moving said ratchet teeth comprises:

means responsive to the closing fluid pressure.

3. The structure of claim 1, wherein said means for moving said ratchet teeth includes:

resilient means for moving said ratchet teeth into engagement.

4. The structure of claim 1, further including:

means for unlocking said lock means.

5. The structure of claim 4, wherein opening fluid pressure is introduced against said ram carrier means to move the ram outwardly from the closed position, and wherein said means for unlocking further comprises:

means responding to the opening fluid pressure to unlock the ram from the closed position.

6. The structure of claim 5, wherein:

said lock nut is engaged by said threaded surface on said ram piston rod for rotational movement with respect thereto during outward movement from the closed position.

7. The structure of claim 4, wherein said means for unlocking comprises:

means for moving said ratchet teeth of said movable clutch plate and said fixed clutch plate out of engagement.

8. The structure of claim 7, wherein opening fluid pressure is introduced against said ram carrier means to move the ram outwardly from the closed position, and wherein said means for unlocking further comprises:

means responding to the opening fluid pressure to move said ratchet teeth out of engagement.

9. The structure of claim 8, wherein said means for unlocking comprises:

a piston adapted for movement in response to opening fluid pressure to a position moving said ratchet teeth out of engagement in response to opening fluid pressures.

10. The structure of claim 1, wherein said means for moving comprises:

means for moving said ratchet teeth of said fixed clutch plate and said lock nut clutch plate into engagement to automatically lock said ram carrier means against outward movement as the ram is moving inwardly.

11. The structure of claim 1, wherein the preventer has at least a pair of rams, and wherein each of the rams has a ram lock for locking the ram at an adjustable closed position for sealing contact with a well pipe or the like in a bore of the blowout preventer, comprising:

(a) ram carrier means comprising a ram piston having a piston rod with a threaded surface formed thereon for moving the ram to the adjustable closed positions in the blowout preventer;

(b) lock means for locking said ram carrier means at adjustable closed positions, comprising:

(1) a lock nut having a threaded surface formed thereon and engaged by said threaded surface on said ram piston rod for rotational movement with respect thereto during movement of the ram;

(2) a movable clutch plate mounted with said lock nut for rotational movement therewith, said movable clutch plate having ratchet teeth formed thereon;

(3) a fixed clutch plate having ratchet teeth formed thereon; and (4) means mounting said fixed clutch plate with the blowout preventer against relative movement with respect thereto; and (c) means for moving said ratchet teeth of said fixed clutch plate and said movable clutch plate into engagement to lock said ram carrier means against outward movement as the ram is moving inwardly.

12. In a blowout preventer, a ram lock for automatically locking the ram against reverse or outward movement during inward movement to a closed position for contact of the ram with a well pipe or the like in a bore of the preventer, comprising:

(a) ram carrier means comprising a ram piston having a piston rod with a threaded surface formed thereon for moving the ram to and from the adjustable closed position;

(b) lock means for locking said ram carrier means against outward movement as the ram is moving inwardly, said lock means comprising:

(1) a lock nut having a threaded surface formed thereon and engaged by said threaded surface on said ram piston rod for rotational movement with respect thereto during movement of the ram;

(2) a movable clutch plate mounted with said lock nut for rotational movement therewith, said movable clutch plate having ratchet teeth formed thereon;

(3) a fixed clutch plate having ratchet teeth formed thereon; and (4) means mounting said fixed clutch plate with the blowout preventer against relative movement with respect thereto; and (c) means for moving said ratchet teeth of said fixed clutch plate and said movable clutch plate into engagement to lock said ram carrier means against outward movement as the ram is moving inwardly.

13. The structure of claim 12, wherein closing fluid pressure is introduced against said ram carrier means to move the ram to the closed position, and further including:

means for automatically moving said teeth of said movable clutch plate and said fixed clutch plate into engagement and resisting relative movement therebetween in response to the closing fluid pressure.

14. The structure of claim 12, wherein said means moving said ratchet teeth includes:

resilient means for moving said ratchet teeth into engagement.

15. The structure of claim 12, further including:

means for unlocking said lock means.

16. The structure of claim 15, wherein opening fluid pressure is introduced against said ram carrier means to move the ram outwardly from the closed position, and wherein said means for unlocking further comprises:

means responding to the opening fluid pressure to unlock the ram from the closed position.

17. The structure of claim 16, wherein:

said lock nut is engaged by said threaded surface on said ram piston rod for rotational movement with respect thereto during outward movement from the closed position.

18. The structure of claim 15, wherein said means for unlocking comprises:

means for moving said ratchet teeth of said movable clutch plate and said fixed clutch plate out of engagement.

19. The structure of claim 18, wherein opening fluid pressure is introduced against said ram carrier means to move the ram outwardly from the closed position, and wherein said means for unlocking further comprises:

means responding to the opening fluid pressure to move said ratchet teeth out of engagement.

20. The structure of claim 19, wherein said means for unlocking comprises:

a piston adapted for movement in response to opening fluid pressure to a position moving said ratchet teeth out of engagement in response to opening fluid pressures.

21. The structure of claim 12, wherein the preventer has at least a pair of rams, and wherein each of the rams has a ram lock for automatically locking the ram against reverse or outward movement during inward movement to a closed position for contact of the ram with a well pipe or the like in a bore of the blowout preventer, comprising:

(a) ram carrier means comprising a ram piston having a piston rod with a threaded surface formed thereon for moving the ram to and from the adjustable closed position;

(b) lock means for locking said ram carrier means against outward movement as the ram is moving inwardly, said lock means comprising:

(1) a lock nut having a threaded surface formed thereon and engaged by said threaded surface on said ram piston rod for rotational movement with respect thereto during movement of the ram;

(2) a movable clutch plate mounted with said lock nut for rotational movement therewith, said movable clutch plate having ratchet teeth formed thereon;

(3) a fixed clutch plate having ratchet teeth formed thereon; and (4) means mounting said fixed clutch plate with the blowout preventer against relative movement with respect thereto; and (c) means for moving said ratchet teeth of said fixed clutch plate and said movable clutch plate into engagement to lock said ram carrier means against outward movement as the ram is moving inwardly.

22. A ram lock for a blowout preventer ram for locking the ram at an adjustable closed position for sealing contact with a well pipe or the like in the blowout preventer, comprising:

(a) ram carrier means comprising a ram piston having a piston rod with a threaded surface formed thereon for moving the ram to the adjustable closed positions in the blowout preventer;

(b) lock means for locking said ram carrier means at adjustable closed positions, comprising:

(1) a lock nut having a threaded surface formed thereon and engaged by said threaded surface on said ram piston rod for rotational movement with respect thereto during movement of the ram;

(2) a movable clutch plate mounted with said lock nut for rotational movement therewith, said movable clutch plate having ratchet teeth formed thereon;

(3) a fixed clutch plate having ratchet teeth formed thereon; and (4) means mounting said fixed clutch plate with the blowout preventer against relative movement with respect thereto; and (c) means for moving said ratchet teeth of said fixed clutch plate and said movable clutch plate into engagement to lock said ram carrier means against outward movement as the ram is moving inwardly.

23. The structure of claim 22, said ram carrier means is responsive to closing fluid pressure to move the ram to the closed position, and wherein said means for moving said ratchet teeth comprises:

means responsive to the closing fluid pressure.

24. The structure of claim 22, wherein said means for moving said ratchet teeth includes:

resilient means for moving said ratchet teeth into engagement.

25. The structure of claim 22, further including:

means for unlocking said lock means.

26. The structure of claim 25, wherein said ram carrier means is responsive to opening fluid pressure to move the ram outwardly from the closed position, and wherein said means for unlocking further comprises:

means responding to the opening fluid pressure to unlock the ram from the closed position.

27. The structure of claim 26, wherein:

said lock nut is engaged by said threaded surface on said ram piston rod for rotational movement with respect thereto during outward movement from the closed position.

28. The structure of claim 25, wherein said means for unlocking comprises:

means for moving said ratchet teeth of said movable clutch plate and said fixed clutch plate out of engagement.

29. The structure of claim 28, wherein said ram carrier means is responsive to opening fluid pressure to move the ram outwardly from the closed position, and wherein said means for unlocking further comprises:

means responding to the opening fluid pressure to move said ratchet teeth out of engagement.

30. The structure of claim 29, wherein said means for unlocking comprises:

a piston adapted for movement in response to opening fluid pressure to a position moving said ratchet teeth out of engagement in response to opening fluid pressure.

31. The structure of claim 22, wherein said means for moving comprises:

means for moving said ratchet teeth of said fixed clutch plate and said movable clutch plate into engagement to automatically lock said ram carrier means against outward movement as the ram is moving inwardly.

32. A ram lock for a blowout preventer ram for automatically locking the ram against reverse or outward movement, during inward movement to a closed position for contact of the ram with a well pipe or the like in a bore of a blowout preventer, comprising:

(a) ram carrier means comprising a ram piston having a piston rod with a threaded surface formed thereon for moving the ram to and from the adjustable closed position;

(b) lock means for locking said ram carrier means against outward movement as the ram is moving inwardly, said lock means comprising:

(1) a lock nut having a threaded surface formed thereon and engaged by said threaded surface on said ram piston rod for rotational movement with respect thereto during movement of the ram;

(2) a lock nut clutch plate mounted with said lock nut for rotational movement therewith, said lock nut clutch plate having ratchet teeth formed thereon;

(3) a fixed clutch plate having ratchet teeth formed thereon; and (4) means mounting said fixed clutch plate with the blowout preventer against relative movement with respect thereto; and (c) means for moving said ratchet teeth of said movable clutch plate and said fixed clutch plate into engagement and resisting relative movement therebetween in response to the closing fluid pressure.

33. The structure of claim 32, wherein said ram carrier means is responsive to closing fluid pressure to move the ram to the closed position, and further including:

means for automatically moving said teeth of said movable clutch plate and said fixed clutch plate into engagement and resisting relative movement therebetween in response to the closing fluid pressure.

34. The structure of claim 32, wherein said means moving said ratchet teeth includes:

resilient means for moving said ratchet teeth into engagement.

35. The structure of claim 32, further including:

means for unlocking said lock means.

36. The structure of claim 35, wherein said ram carrier means is responsive to opening fluid pressure to move the ram outwardly from the closed position, and wherein said means for unlocking further comprises:

means responding to the opening fluid pressure to unlock the ram from the closed position.

37. The structure of claim 36, wherein:

said lock nut is engaged by said threaded surface on said ram piston rod for rotational movement with respect thereto during outward movement from the closed position.

38. The structure of claim 35, wherein said means for unlocking comprises:

means for moving said ratchet teeth of said movable clutch plate and said fixed clutch plate out of engagement.

39. The structure of claim 38, wherein said ram carrier means is responsive to opening fluid pressure to move the ram outwardly from the closed position, and wherein said means for unlocking further comprises:

means responding to the opening fluid pressure to move said ratchet teeth out of engagement.

40. The structure of claim 39, wherein said means for unlocking comprises:

a piston adapted for movement in response to opening fluid pressure to a position moving said ratchet teeth out of engagement in response to opening fluid pressures.

* * * * *